United States Patent [19]

Saliger et al.

[11] 4,276,932

[45] Jul. 7, 1981

[54] WELL CASING HANGER ASSEMBLY

[75] Inventors: Kenneth C. Saliger, Houston, Tex.; Martin B. Jansen, Agoura, Calif.

[73] Assignee: NL Industries, Inc., New York, N.Y.

[21] Appl. No.: 83,200

[22] Filed: Oct. 10, 1979

[51] Int. Cl.[3] ..... F16L 39/00; E21B 43/10

[52] U.S. Cl. ..... 166/214; 166/217

[58] Field of Search ..... 166/208, 214, 216, 217; 285/140, 141

[56] References Cited

U.S. PATENT DOCUMENTS

| | | | |
|---|---|---|---|
| 3,420,308 | 1/1969 | Putch | 285/140 |
| 3,590,922 | 7/1971 | Slack | 166/208 |
| 3,893,717 | 7/1975 | Nelson | 166/208 |
| 4,181,331 | 1/1980 | Cowan | 166/208 |

*Primary Examiner*—James A. Leppink

[57] ABSTRACT

A well casing hanger assembly for releasably connecting a first well casing to and from a second member by a resiliently self-expandable and contractible C-shaped spring support ring. The ring is positioned in a recess in the hanger body between stop shoulders for axially slideable movement thereon and is engageable with a locking means for locking the spring support in an expanded position. Coacting engagement between the hanger body and the support ring allows longitudinal movement of the support ring relative to the body but prevents rotational movement of the support ring relative to the body. A fluid flow slot is positioned in the periphery of the hanger body and is aligned with the split in the C-shaped spring support ring for providing a larger bearing area between the support spring and the hanger body without a loss in fluid flow area. Preferably the flow slot includes a single flow slot resulting in a higher load capacity for the hanger and the coacting engaging means includes a vertical pin connected to the support ring engaging a groove in the hanger body.

4 Claims, 3 Drawing Figures

WELL CASING HANGER ASSEMBLY

BACKGROUND OF THE INVENTION

It is generally old, as shown in U.S. Pat. Nos. 3,420,308 and 3,893,717, to support an inner casing in a well from an outer casing by means of a resiliently self-expandable and contractible C-shaped spring support ring. However, the body of the casing hanger is generally provided with a plurality of fluid flow slots which must be sufficiently large to provide the desired fluid return area. The use of large number and area of fluid flow slots reduces the bearing area between the support spring and the hanger body which results in a lower load capacity for the hanger. In addition, the ring blocks at least some of the flow slots and reduces the fluid return area.

The present invention is directed to an improved casing hanger assembly which has a sufficient fluid flow slot area to accommodate the necessary fluid return, but yet provide a larger bearing area between the support spring and the hanger body which will provide a higher load capacity for the casing hanger.

SUMMARY

The present invention is directed to a well hanger assembly for releasably supporting a first tubular member, such as a casing, from another member and which includes a resiliently self-expandable and contractible C-shaped spring support ring which is positioned in a recess in the hanger body and axially slideable thereupon between upper and lower stop shoulders. Locking means are provided on the first member for locking the ring in an expanded position. In order to increase the bearing area between the spring support and first member coacting means are provided on the first member and the support ring which allow longitudinal movement of the support ring relative to the first member but prevent rotational movement of the support ring relative to the first member for maintaining a maximum bearing contact. A fluid flow slot positioned in the periphery of the first member is aligned with and remains aligned with the split in the C-ring support to provide the necessary fluid return area.

Yet a still further object of the present invention is the provision wherein the coacting means includes a vertical pin connected to the support ring which engages a longitudinal groove in the first member thereby aligning the hanger support ring with the hanger body at all times regardless of whether the support ring is in the unset, collapsed, or locked and expanded position.

Still a further object of the present invention is the provision wherein the fluid flow slot includes a single slot extending through the lower and upper stop shoulders for providing a sufficient fluid flow area which is not blocked by the support ring and which allows an increased load bearing area between the support ring and the first member.

Still other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the present invention is useful in various types of casing hangers, for purposes of illustration only the present invention will be described in connection with a casing hanger of the type generally shown in FIGS. 3 and 4 of U.S. Pat. No. 3,893,717.

Figure 1:
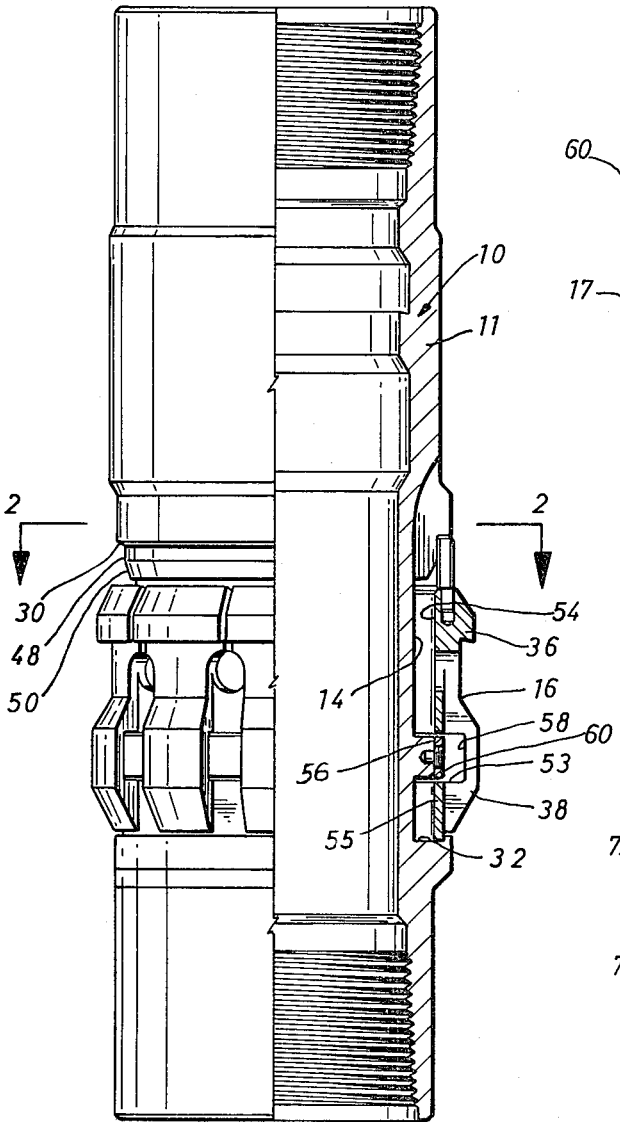
FIG. 1 is an elevational view, partly in cross section, of a casing hanger of the present invention.

Referring now to the drawings, particularly to FIG. 1, a first inner casing hanger 10 is shown which is desired to be connected and released from a second outer casing hanger (not shown), both of which are tubular members. The casing hanger 10 is adapted to be supported from the outer casing hanger and in turn supports a string of casing in a well. The casing hanger assembly 10 includes an annular recess 14 in its outer peripheral surface for carrying a resiliently self-expandable and contractible C-shaped spring support ring generally indicated by the reference numeral 16.

Figure 2:
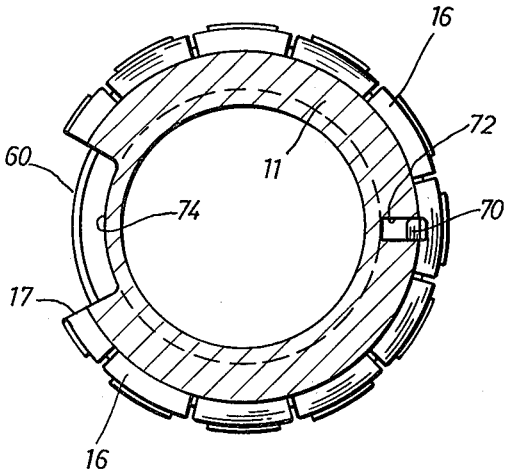
FIG. 2 is a cross-sectional view taken along the line 2—2 of FIG. 1.

The support ring may be of any suitable type such as that illustrated in FIG. 2 of U.S. Pat. No. 3,893,717 and in which the ring 16 has a split 17 for allowing the ring 16 to be expanded and contracted on the casing hanger 10.

The casing hanger body 11 is provided with an upper radially extending stop shoulder 30 at the top of the recess 14 and a lower radially extending stop shoulder 32 at the bottom of the recess 14. The support ring 16 is axially slideable in the recess 14 between the upper stop shoulder 30 and the lower stop shoulder 32. The recess 14 supports the support ring 16 and allows the ring 16 to contract inwardly into the recess 14 as the hanger assembly 10 is moved downhole through an outer casing. The ring 16 includes an upper locking portion 36 and a lower key portion 38 for coacting with a locking notch in the second casing hanger assembly (not shown).

The recess 14 includes a locking shoulder 48 on the hanger body 11 below and adjacent the stop shoulder 30 and a tapered shoulder 50 to assist in moving the support ring 16 outwardly and into engagement with a locking notch on longitudinal downward movement of the casing hanger assembly 10 relative to the support ring 16 when the ring 16 engages the notch in the outer casing hanger assembly. A locking surface 54 is provided on the back side of the ring 16 adjacent its upper end for coaction with the locking shoulder 48 for maintaining the support ring 16 in the expanded and locked position whereby the casing hanger assembly 10 may be connected to and suspended from an outer casing hanger assembly so long as weight is exerted downwardly on the casing hanger assembly 10.

If desired, a second locking shoulder 56 is positioned in the recess 14 and connected to the hanger body 11 and positioned between the stop shoulders 30 and 32 and extend radially outwardly from the recess 14 approximately the same radial distance as the first locking shoulder 48. A receiving notch 58 may be provided in the back side of the support ring 16 which initially coacts with the second locking shoulder 56 and/or shear ring 60 for allowing the ring 16 to be retracted in the recess 14, but which also allows the ring 16 to expand outwardly and axially move toward the top of the recess 14. The coaction between the second locking shoulder 56 and/or shear ring 60 and the receiving notch 58 restrict the axial movement of the support ring 16 as the casing hanger assembly 10 is moved downhole, but allows the expansion of the support ring 16 when the ring 16 becomes properly aligned with a locking notch. Preferably shear means are provided for initially restricting the longitudinal or axial movement of the ring 16 relative to the recess 14 such as connecting the ring 60 to the locking shoulder 56 by shear pins 62. When the support ring 16 is brought into alignment with a locking notch on a second casing hanger, the ring 16 is expanded and downward movement of the first casing hanger assembly 10 relative to the ring 16 causes the surface 53 of the receiving notch 58 to bear on ring 60 and shear the pin 62. Upon further downward movement of the casing hanger assembly 10, the ring 16 is forced further outwardly by the coaction of the tapered shoulder 50 and a still further downward movement of the hanger assembly 10 brings the locking shoulders 48 and 56 behind the back of the ring 16 and securely locks the ring 16 in an expanded position.

The casing hanger assembly 10 may be easily released by an upward longitudinal movement of the casing hanger 10 which will allow the support ring 16 to be moved axially downward and the lower end of the ring 16 to contact the stop shoulder 32 and the notch 58 is thereby aligned with the shoulder 56 and upward movement of the casing hanger assembly 10 allows the support ring 16 to be retracted into the recess 14 and the assembly 10 moves uphole. The above description of a well casing hanger assembly and its operation is generally described in U.S. Pat. No. 3,893,717.

It is necessary that the area between the inner casing hanger 10 and the outer casing hanger be sufficient to provide a fluid flow area between the assemblies and it has been conventional to supply a plurality of fluid flow slots in the periphery of the body 11 extending through the upper stop shoulder 30 and lower stop shoulder 32 to provide the maximum fluid return area. However, the provision of fluid flow slots through the upper stop shoulder 30 reduces the bearing area between the top of the support ring 16 and the shoulder 30 through which the entire load of the casing hanger 10 is carried. The load bearing capacity of the hanger 10 is further reduced since the split 17 in the ring 16 includes an area which does not carry any load. In addition, the fluid flow slots are partially blocked by the support ring 16 thereby requiring greater area and further decreasing the bearing areas.

The present invention is directed to providing coacting means between the hanger body 11 and the support ring 16 which allows longitudinal movement of the support ring relative to the body 11, regardless of whether the ring 16 is contracted, expanded, or set, but prevents rotational movement of the support ring 16 relative to the body member 11. In addition, the split 17 in the C-shaped support ring 16 is aligned with a fluid flow slot for providing a larger bearing area between the spring 16 and the hanger body 11 without a loss in return fluid flow area with the result that a higher load capacity for the hanger assembly 10 is obtained.

Figure 3:
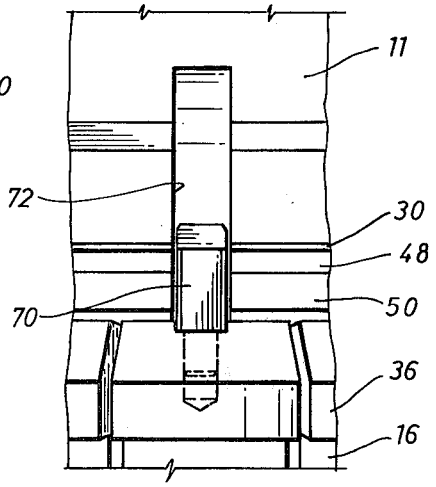
FIG. 3 is an enlarged fragmentary elevational view of the coacting means for maintaining rotational alignment between the hanger body and the support ring.

Referring to FIGS. 1, 2 and 3, coacting means are provided between the body 11 and the support ring 16 such as a pin 70 rigidly connected to the support ring 16 and a groove 72 in the body 11 for aligning the resilient support spring ring 16 with the body 11 at all times, that is, whether the spring 16 is set, unset, collapsed or expanded. The pin 70 will longitudinally move in the groove 72 but will prevent rotative movement between the ring 16 and the body 11. Preferably the pin 70 is connected to the support ring 16 diametrically opposite the split 17 in the support ring 16.

Referring to FIG. 2, the hanger body 11 includes a milled slot 74 which aligns with the split 17 in the support ring 16 to provide the required flow by area for cementing operations with a minimum of interference to fluid flow from the ring 16. Preferably only a single flow by slot 74 is provided and it is to be noted that the areas which do not provide any load support, that is, the mill slot 74 on the body 11 and the split 17 in the ring 16 are aligned with the result that a greater bearing area is otherwise obtained between the stop shoulder 30 and the spring 16 obtaining a higher load capacity for the hanger assembly 10.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will readily suggest themselves to those skilled in the art and which are encompassed within the spirit of the invention and the scope of the appended claims.

What is claimed is:

1. In a casing hanger assembly for releasably supporting a first tubular member to and from a second member in a well by longitudinal movement of the first member, said first member including an annular recess in its peripheral surface, a radially extending stop shoulder on the first member at each end of the recess, a resiliently expandable and contractible C-shaped spring support ring positioned in the recess and axially slidable thereon between said stop shoulders and locking means on the first member for locking said ring in an expanded position, the improvement comprising, coacting means on said first member and said support ring allowing longitudinal movement of the support ring relative to the first member but preventing rotational movement of the support ring relative to the first member, and a fluid flow slot positioned in the periphery of said first member aligned with the split in the C-shaped support ring.

2. The apparatus of claim 1 wherein said coacting means includes a vertical pin connected to the support ring engaging a groove in said first member.

3. The apparatus of claims 1 and 2 wherein said flow slot includes a single flow slot extending through said stop shoulders providing a sufficient fluid flow area as well as an increased load bearing area between the support ring and the first member.

4. The apparatus of claims 2 and 3 wherein the pin is connected to the support ring diametrically opposite the split in the support ring.

* * * * *